US007328853B2

(12) United States Patent
Carey et al.

(10) Patent No.: US 7,328,853 B2
(45) Date of Patent: Feb. 12, 2008

(54) REVERSIBLE SPRAY TIP UNIT

(75) Inventors: Danuta H. Carey, Stockholm, NJ (US); John Plocic, Stockholm, NJ (US); Christopher M. Walsh, Florham Park, NJ (US)

(73) Assignee: TriTech Industries Inc., Union, NJ (US)

( * ) Notice: Subject to any disclaimer, the term of this patent is extended or adjusted under 35 U.S.C. 154(b) by 56 days.

(21) Appl. No.: 11/269,949

(22) Filed: Nov. 9, 2005

(65) Prior Publication Data

US 2007/0102535 A1 May 10, 2007

(51) Int. Cl.
*B67D 5/38* (2006.01)

(52) U.S. Cl. ..... 239/74; 239/71; 239/119; 40/299.01; 40/332; 40/634

(58) Field of Classification Search ..... 239/104–123, 239/74, 71, 73; 40/634, 299.01, 332
See application file for complete search history.

(56) References Cited

U.S. PATENT DOCUMENTS 1,369,017 A * 2/1921 Falconer ..... 40/634
1,841,780 A * 1/1932 Biggs et al. ..... 40/634
1,984,069 A * 12/1934 Larter ..... 70/457
2,208,152 A * 7/1940 Badhorn ..... 248/303
4,133,195 A * 1/1979 McLaren ..... 70/456 R
4,508,268 A 4/1985 Geberth, Jr.
4,611,758 A 9/1986 Geberth, Jr.
6,264,115 B1 * 7/2001 Liska et al. ..... 239/119
6,481,640 B1 11/2002 Carey et al.

OTHER PUBLICATIONS

U.S. Appl. No. 10/886,855, filed Jul. 2004. Carey et al.

* cited by examiner

*Primary Examiner*—Dinh Q. Nguyen
(74) *Attorney, Agent, or Firm*—Buckman and Archer

(57) ABSTRACT

There is provided a turret member for a reversible airless spray tip unit having an easily readable identification device or indicia for the particular turret member imprinted on a tag or label attached to a securing device or attaching ring secured to the handle of the turret member. A plurality of turret members are carried on a keychain by their attachment rings for their ease of accessibility to the operator.

14 Claims, 4 Drawing Sheets

REVERSIBLE SPRAY TIP UNIT

FIELD OF THE INVENTION

The present invention relates to spray tips for use with spray guns adapted for the hydraulic atomization and spraying of liquids such as paint wherein the spray tip is reversible so that obstructions therein which clog the spray tip nozzle or opening may be easily removed by the reversed flow of the high pressure liquid paint through the spray tip.

BACKGROUND OF THE INVENTION

A reversible spray tip unit or assembly with which the present invention is concerned is used in hydraulic or airless paint spraying and generally includes a rotatable cylindrically shaped turret member arranged in a housing transverse to the flow of high pressure paint. The turret member is provided with a diametric fluid bore at one end of which is mounted the spray tip or nozzle. The spray tip unit housing is engaged by a securing nut which secures the spray tip unit to the discharge end of the spray gun. The spray tip unit housing permits the turret member to be axially rotated therein so as to present the spray tip or nozzle forwardly for spray painting and rearwardly facing the discharge end of the spray gun whereby clogs or obstructions in the spray tip can be removed by the reversed flow of paint therethrough. The turret member is provided with a generally T-shaped handle at one end thereof so that it may be easily rotated as required. The turret member is easily removed from the spray tip unit by slackening the securing nut and pulling the turret member by its T-shaped handle from the spray tip unit housing. The spray tip unit housing is provided with a molded plastic tip guard having Y or V-shaped forward extending ears which guard against accidental injection by the fluid stream exiting the nozzle.

During the course of normal painting operations by a painting contractor, it is frequently necessary to change spray tips because of nozzle wear or because a different size spray tip is required. This is easily accomplished by slackening the securing nut of the spray tip unit housing to thereby release the pressure on the turret member which can then be withdrawn from the housing and replaced with another. Thus, the operator must have available an assortment of turret members having different sized spray tips so that he can sort through these turret members to find the desired replacement which he can then insert into the spray tip unit housing, tighten the securing nut, and recommence the painting operation. Obviously, it is important that this assortment of turret members be conveniently available or readily at hand so that the painting operator can choose the appropriate replacement and make the exchange with as little downtime as possible.

Usually, each turret member has inscribed on its T-shaped handle or elsewhere, a designation indicating the nozzle size. Obviously, because of spatial constraints, the dimensions of the inscribed designations are relatively small and require close scrutiny in order to ascertain the size of the nozzle. Thus, when the painting operator replaces a turret member, it is necessary that he closely examine the turret member he is currently using to ascertain the size needed and then examine the assortment of turret members at his disposal in order to choose the correct size. However, during the painting operation the tip handle of the tip being used has a tendency to become coated with paint because of paint spray in the air resulting in size identification being difficult or impossible. Another difficulty has to do with the operator spraying in difficult to reach places and utilizing a ladder or scaffold. In such a situation, the painting operator is not likely to carry with him or have ready access to an assortment of turret members while on the ladder or scaffold and so the operator is faced with the inconvenience and sometimes the danger of climbing down from the ladder or scaffold in order to locate an appropriate replacement turret member.

SUMMARY OF THE INVENTION

It is a primary object of the present invention to provide an improved turret member for a reversible airless spray tip unit which permits a painting operator or user during the painting operation, to easily and quickly determine the size of the spray tip being used and to easily and quickly choose a replacement turret member from a plurality of turret members and thereby avoid excessive down time during the replacement process.

The above object, as well as others which will hereinafter become apparent, is accomplished in accordance with the present invention by providing a turret member for a reversible airless spray tip unit having the usual T-shaped plastic handle at one end thereof with a through opening in the cross bar of the T-shaped handle. A securing device or attachment ring is received in the through opening of the handle and a tag attached thereto indicating the size of the spray nozzle or other pertinent information. A plurality of turret members can be assembled and collected together by attaching their securing devices or attachment rings to a common holder such as a key ring or key chain from which individual turret members can be easily selected and detached as required.

BRIEF DESCRIPTION OF THE DRAWINGS

The present invention will be described and understood more readily when considered together with the accompanying drawings, in which.

DETAILED DESCRIPTION OF THE INVENTION

Figure 1:
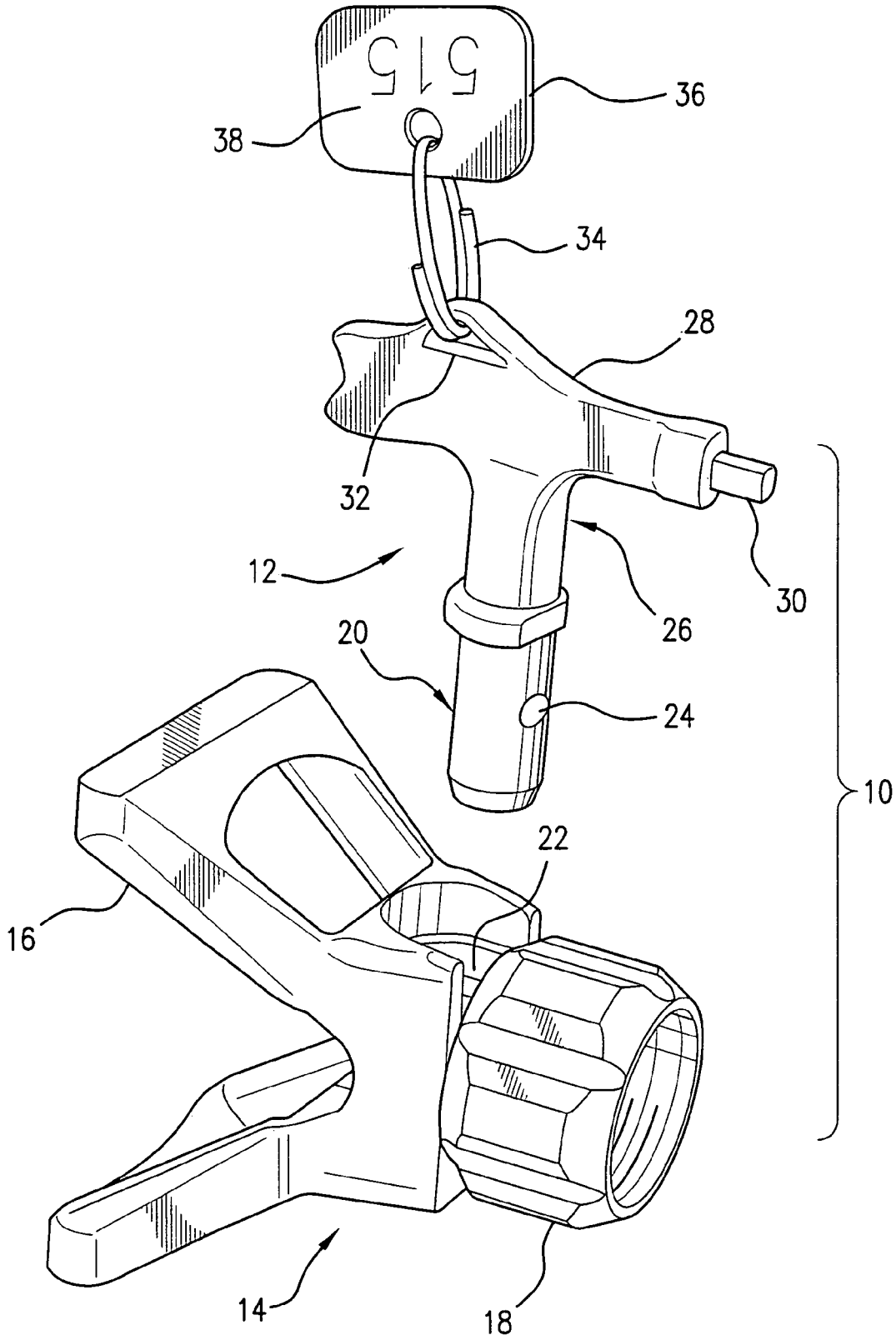
FIG. 1 is a partially exploded perspective view of a reversible spray tip unit embodying the present invention.

Now turning to the drawings, there is shown in FIG. 1, a reversible spray tip unit, generally designated 10, including a turret member 12 and a spray tip unit housing 14. Spray tip unit housing 14 includes a forward extending spray tip guard 16 and a securing nut 18 for securing the spray tip unit to the forward end of a spray gun (not shown). Turret member 12 includes a barrel shaped member 20 which is received for axial rotation in cylindrically shaped transverse bore 22 formed in spray tip unit housing 14. A diametric fluid bore 24 is formed in barrel shaped member 20 which houses a spray nozzle or spray tip (not shown) at one end thereof. Barrel shaped member 20 of turret member 12 is adapted for rotation in bore 22 of spray tip unit housing 14 so as to present the spray nozzle housed in bore 24 forwardly for spray painting or rearwardly facing the spray gun outlet for removal of clogs or obstructions in the spray nozzle. In order to effect the rotation of barrel shaped member 20 in bore 22, a T-shaped plastic handle 26 is attached to an end of member 20. The cross-member 28 of handle 26 is conveniently arrow shaped whereby the tip 30 thereof points in the direction of the spray exiting the spray nozzle housed in bore 24. Thus, when tip 30 of handle 26 is directed forwardly, the reversible spray tip unit 10 is disposed for spray painting and when tip 30 is directed rearwardly, reversible spray tip unit 10 is disposed for dislodging clogs or obstructions in the spray nozzle.

Figure 3:
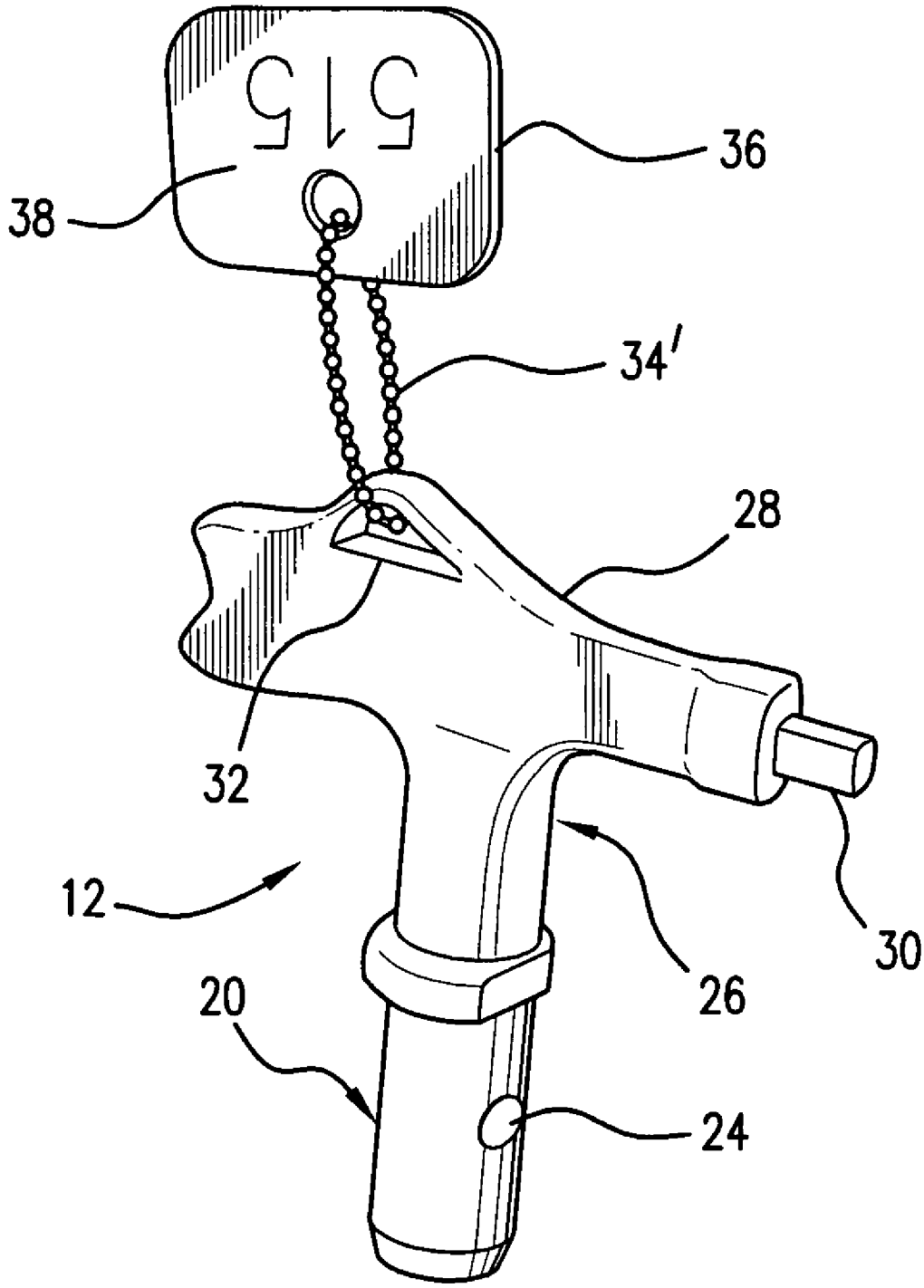
FIG. 3 shows a portion of the turret member with an attachment ring in the nature of a ball chain.
Figure 4:
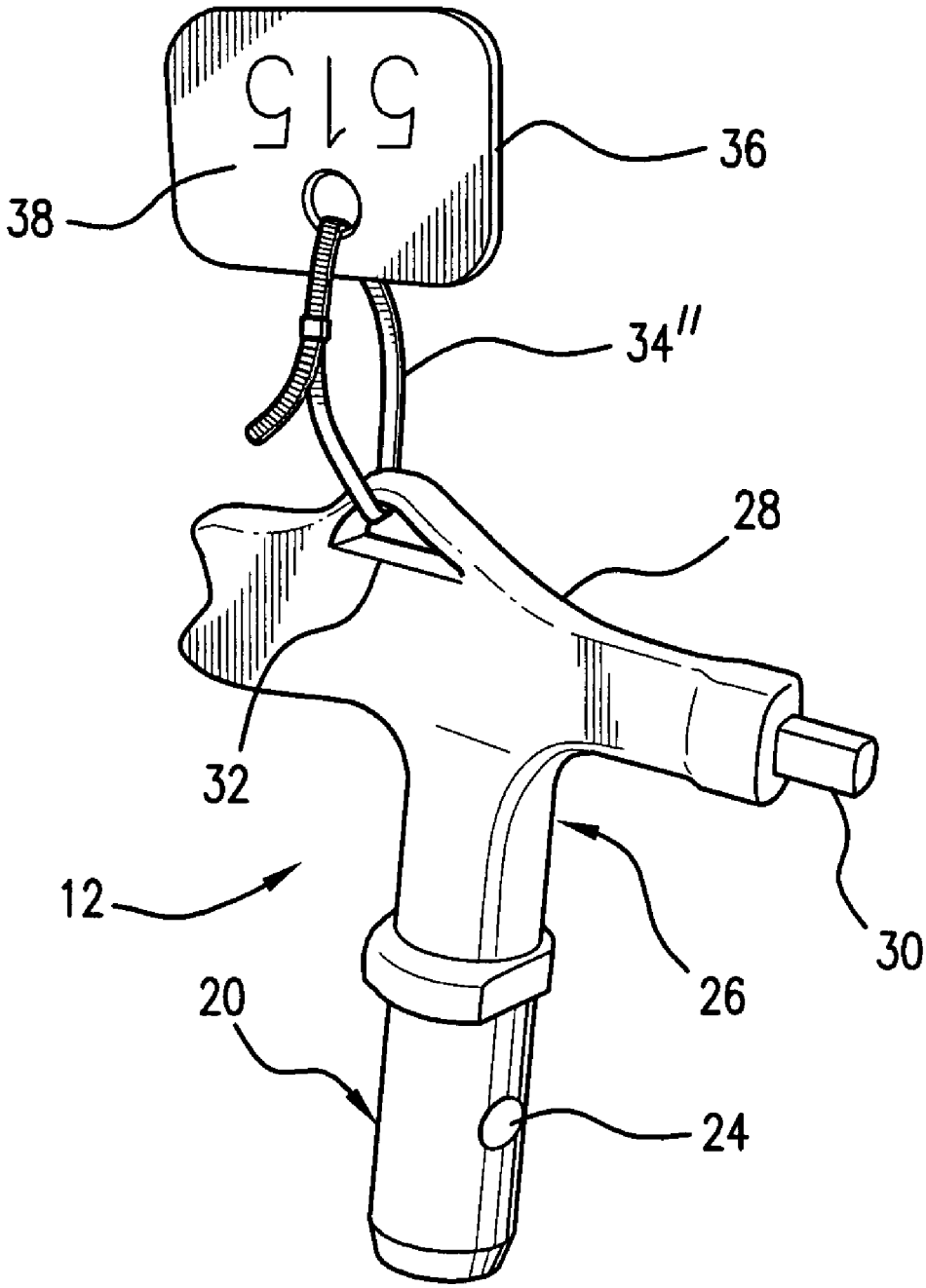
FIG. 4 shows a portion of the turret member with an attachement ring in the nature of a plastic cable tie.

A through opening, designated 32, is provided in cross-member 28 of handle 26 at approximately midway along the length thereof. A securing device, designated 34, in the nature of an attachment ring, a key ring, a wire helix, a ball chain 34'(see FIG. 3), a plastic cable tie 34"(see FIG. 4) or similar device is threaded through opening 32 and is provided with a tag 36. Tag 36 can be imprinted with a suitable identification device 38 such as a model number or other indicia related to the spray tip or nozzle size. As clearly seen, tag 36 can be a relatively large element and can therefore accommodate a relatively large identification device 38 thereon which can be easily discerned by the painting operator.

Figure 2:
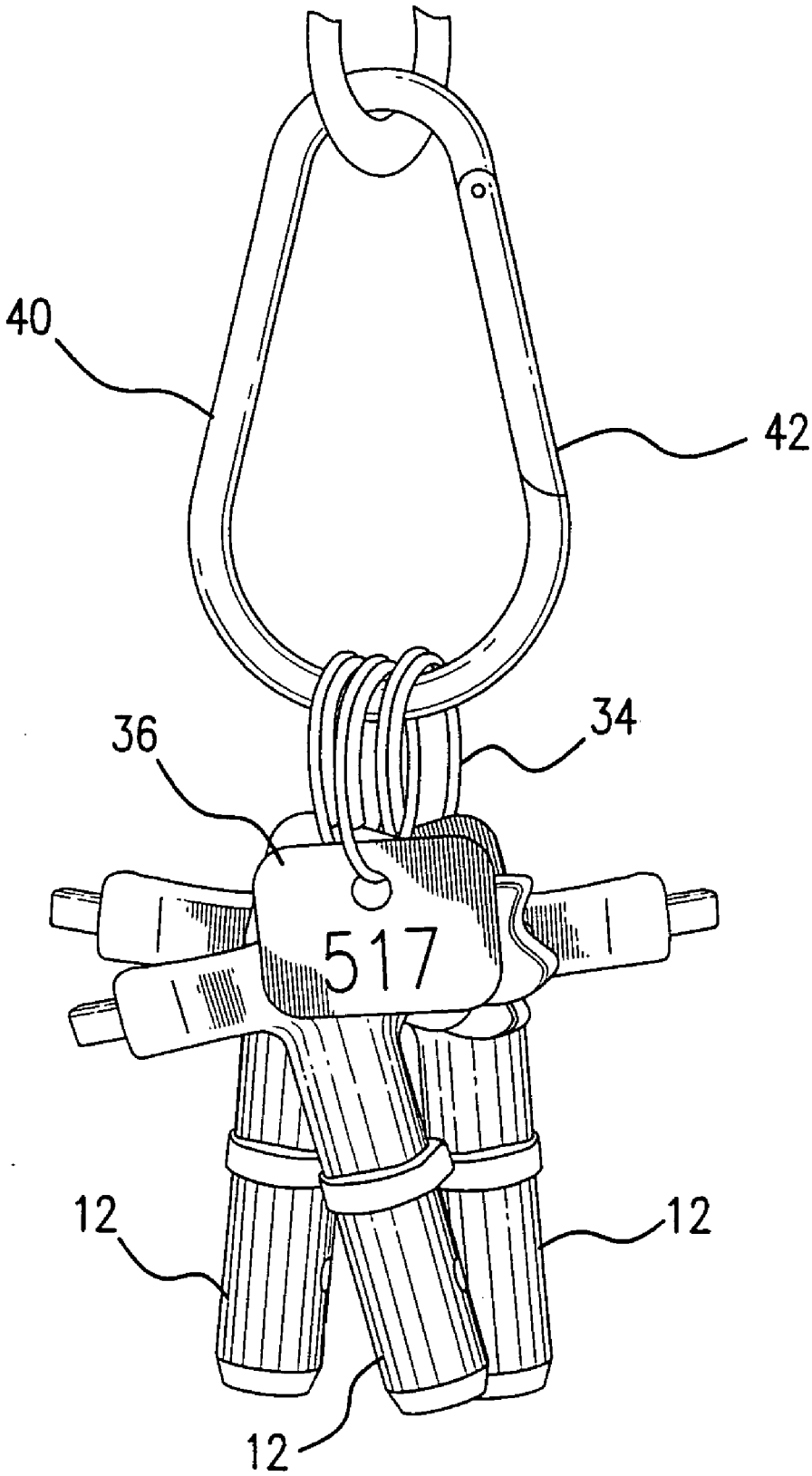
FIG. 2 is an elevational view of a keychain holding a plurality of turret members.

In FIG. 2, there is shown a plurality of turret members 12 attached to a keychain, designated 40, by means of the securing devices or attachment rings 34 of the turret members. Keychain 40 may be in the form of a carabiner or D-ring or similar device having an openable clasp or latch 42 to permit removal of the individual turret members. Keychain 40 may be conveniently carried by the painting operator by attachment to his belt. In this way it is a very simple matter for the painting operator to quickly replace a turret member for whatever reason with a new one chosen from the plurality of turret members carried on keychain 40. It is only necessary for the painting operator to quickly scan the identification devices 38 of tags 36 of the plurality of turret members 12 carried on keychain 40 to determine a suitable turret member and then remove the same from the keychain and install it in the spray tip unit housing being used.

While only a single embodiment of the present invention has been shown and described, it will be obvious that many changes and modifications may be made thereto without departing from the spirit and scope of the present invention.

What is claimed is:

1. In a reversible spray tip unit for use with spray guns adapted for the hydraulic atomization and spraying of paint, the spray tip unit includes a rotatable cylindrically shaped turret member arranged in a housing transverse to a flow of high pressure paint through said housing and having a securing nut for securing the spray tip unit to a discharge end of a spray gun, the turret member has a diametric fluid bore at one end of which is mounted a spray nozzle and a generally T-shaped handle arranged at one end of the cylindrically shaped turret member for rotation thereof, the improvement comprising a securing device attached to the T-shaped handle of the turret member and an identification tag attached to said securing device having identification indicia conspicuously displayed thereon.

2. The reversible spray tip unit as defined in claim 1, wherein said securing device is an attachment ring.

3. The reversible spray tip unit as defined in claim 1, wherein said securing device is a key ring.

4. The reversible spray tip unit as defined in claim 1, wherein said securing device is a wire helix.

5. The reversible spray tip unit as defined in claim 1, wherein said securing device is a ball chain.

6. The reversible spray tip unit as defined in claim 1, wherein said securing device is a plastic cable tie.

7. The reversible spray tip unit as defined in claim 1, wherein the T-shaped handle of the turret member is provided with a through opening for the attachment of said securing device.

8. A turret member for a reversible spray tip unit for use with spray guns adapted for hydraulic atomization and spraying of paint, the spray tip unit includes a rotatable cylindrically shaped turret member arranged in a housing transverse to a flow of high pressure paint and a securing nut for securing the spray tip unit to a discharge end of a spray gun, the turret member includes a diametric fluid bore at one end of which is mounted a spray nozzle and a generally T-shaped handle arranged at one end of the cylindrically shaped turret member for rotating the turret member in the spray tip housing, the turret member further includes a securing device attached to the T-shaped handle of the turret member, and an identification tag attached to said securing device having identification indicia conspicuously displayed thereon.

9. The turret member as defined in claim 8, wherein said securing device is an attachment ring.

10. The turret member as defined in claim 8, wherein said securing device is a key ring.

11. The turret member as defined in claim 8, wherein said securing device is a wire helix.

12. The turret member as defined in claim 8, wherein said securing device is a ball chain.

13. The turret member as defined in claim 8, wherein said securing device is a plastic cable tie.

14. The turret member as defined in claim 8, wherein the T-shaped handle of the turret member is provided with a through opening for the attachment of said securing device.

* * * * *